US010450854B2

(12) United States Patent
Marland et al.

(10) Patent No.: US 10,450,854 B2
(45) Date of Patent: Oct. 22, 2019

(54) METHODS AND APPARATUS FOR MONITORING WELLBORE TORTUOSITY

(71) Applicant: HALLIBURTON ENERGY SERVICES, INC., Houston, TX (US)

(72) Inventors: Christopher Neil Marland, Spring, TX (US); Jeremy Alexander Greenwood, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 130 days.

(21) Appl. No.: 15/518,324

(22) PCT Filed: Nov. 9, 2015

(86) PCT No.: PCT/US2015/059760

§ 371 (c)(1),
(2) Date: Apr. 11, 2017

(87) PCT Pub. No.: WO2016/077239

PCT Pub. Date: May 19, 2016

(65) Prior Publication Data

US 2017/0306748 A1 Oct. 26, 2017

Related U.S. Application Data

(60) Provisional application No. 62/077,758, filed on Nov. 10, 2014.

(51) Int. Cl.
*E21B 47/022* (2012.01)
*E21B 44/00* (2006.01)
(Continued)

(52) U.S. Cl.
CPC ..... *E21B 47/022* (2013.01); *E21B 44/00* (2013.01); *E21B 44/005* (2013.01); *E21B 47/0006* (2013.01); *E21B 47/122* (2013.01)

(58) Field of Classification Search
CPC .... E21B 47/022; E21B 47/122; E21B 44/005; E21B 44/00; E21B 47/0006
See application file for complete search history.

(56) References Cited

U.S. PATENT DOCUMENTS 4,821,563 A 4/1989 Maron
6,438,495 B1 8/2002 Chau et al.
(Continued)

FOREIGN PATENT DOCUMENTS

CA 2658831 A1 8/2007
CN 1145444 A 3/1997
(Continued)

OTHER PUBLICATIONS

Canadian Intellectual Property Office, Application No. 2,963,389, Apr. 24, 2018, 6 pages, Canada.
(Continued)

*Primary Examiner* — Regis J Betsch
*Assistant Examiner* — Jeremy A Delozier

(57) ABSTRACT

The present disclosure describes measuring bending moments within a drillstring or tool string to identify deflections (or "dog-legs") within the string. In some systems, the bending moments a plurality of strain gauges. In some such systems the strain gauges will be arranged in a selected spacing around the circumference of the tool string, in many examples, at a common plane extending generally perpendicular to the longitudinal axis of the string proximate the strain gauges. The bending moments may be further evaluated to provide a measure of wellbore tortuosity. For example, the bending moments may be utilized to define a radius of curvature associated with the determined bending moments, which may be further correlated with a directional measurement to apply a direction to the bending moment, and therefore to the tortuosity an any given location. In many examples, the above measurements and determina-
(Continued)

tions will be performed in essentially real time during a drilling operation; and will in some cases be used to perform remedial measures, where dictated.

17 Claims, 8 Drawing Sheets

(51) Int. Cl.
*E21B 47/00* (2012.01)
*E21B 47/12* (2012.01)

(56) References Cited

U.S. PATENT DOCUMENTS

| | | | | |
|---|---|---|---|---|
| 6,547,016 | B2 | 4/2003 | Wassell | |
| 7,503,403 | B2 | 3/2009 | Jogi et al. | |
| 2005/0150689 | A1* | 7/2005 | Jogi | E21B 7/06 175/45 |
| 2012/0046865 | A1 | 2/2012 | Heisig et al. | |
| 2013/0041586 | A1 | 2/2013 | Schuberth et al. | |
| 2013/0304384 | A1* | 11/2013 | Rabinovich | E21B 47/026 702/6 |
| 2014/0172303 | A1 | 6/2014 | Ibrahim | |
| 2014/0231141 | A1* | 8/2014 | Hay | E21B 44/00 175/45 |
| 2014/0284103 | A1* | 9/2014 | Niina | E21B 47/00 175/24 |

FOREIGN PATENT DOCUMENTS

| | | | |
|---|---|---|---|
| RU | 2007135014 | A | 3/2009 |
| RU | 2407888 | C2 | 12/2010 |
| WO | WO-9221848 | | 12/1992 |
| WO | WO-2008085642 | A2 | 7/2008 |

OTHER PUBLICATIONS

Russian Federation Intellectual Property Office, Office Action and Search Report, May 7, 2018, 9 pages, Russia.
Korean Intellectual Property Office, International Search Report and Written Opinion, Jan. 28, 2016, 14 pages, Korea.
Chris Marland and Jeremy Greenwood, Strain-Gauge Bending-Moment Measurements Used to Identify Wellbore Tortuosity, Mar. 17-19, 2015, 11 pages, SPE/IADC-173039-MS, SPE/IADC Drilling Conference and Exhibition, London, United Kingdom.
Canadian Intellectual Property Office, Application No. 2,963,389, First Examiner's Letter and Search Report, Dec. 21, 2018, 7 pages, Canada.
Chinese State Intellectual Property Office, Application No. 201500550841, First Office Action, Apr. 23, 2019, 9 pages, China.
Chinese State Intellectual Property Office, Application No. 201500550841, Search Report, Apr. 11, 2019, 3 pages, China.

* cited by examiner

METHODS AND APPARATUS FOR MONITORING WELLBORE TORTUOSITY

PRIORITY APPLICATION

This application is a U.S. National Stage patent application of International Patent Application No. PCT/US2015/059760, filed on Nov. 9, 2015, which claims the benefit of U.S. Provisional Ser. No. 62/077,758, filed on Nov. 10, 2014, the benefit of both of which are claimed and the disclosure of both of which are incorporated herein by reference in their entireties.

BACKGROUND

The present disclosure relates to measuring while drilling techniques and, more particularly, to methods and apparatus for measuring bending moments in a tool string as an indicator of wellbore tortuosity, and for using such measured bending moments.

To obtain hydrocarbons such as oil and gas, boreholes are drilled by rotating a drill bit attached at a drill string end. A proportion of the current drilling activity involves directional drilling (e.g., drilling deviated and/or horizontal boreholes) to steer a well towards a target zone and increase hydrocarbon production from subterranean formations. Modern directional drilling systems generally employ a drill string having a bottom-hole assembly (BHA) and a drill bit situated at an end thereof that may be rotated by rotating the drill string from the surface, using a mud motor arranged downhole near the drill bit, or a combination of the mud motor and rotation of the drill string from the surface.

The BHA generally includes a number of downhole devices placed in close proximity to the drill bit and configured to measure certain downhole operating parameters associated with the drill string and drill bit. Such devices typically include sensors for measuring downhole temperature and pressure, azimuth and inclination measuring devices, and a resistivity measuring device to determine the presence of hydrocarbons and water. Additional downhole instruments, known as logging-while-drilling ("LWD") and measuring-while-drilling ("MWD") tools, are frequently attached to the drill string to determine the formation geology and formation fluid conditions during the drilling operations.

Boreholes are usually drilled generally along predetermined desired paths identified in a well plan and typically extend through a plurality of different earth formations. In the course of such following of a well plan, a number of adjustments in the drilled well bore trajectory are required in order to make adjustments in inclination or azimuth, and even to maintain drilling in a generally linear path. As a result, during the drilling of a well there can be many adjustments in steering of the bit, and of maintaining direction of a bit, which result in changes in inclination and/or azimuth. While survey measurements performed during the drilling of the well can indicate the path of the wellbore, which may then be compared to a well-plan, such survey measurements tend to present a relatively generalized indication of the wellbore path, and can suggest a smoother wellbore profile that actually exists. For example, such survey measurements provide minimal information regarding spiraling of the wellbore, or of localized directional shifts (i.e., deflections or "dog-legs"), of magnitudes that can present greater strains upon a tool string than would be apparent from conventional survey measurements. Such spiraling or dog-legs, or other forms of well bore tortuosity, can be problematic to the drilling operations or subsequent operations within the well.

DETAILED DESCRIPTION

The following detailed description refers to the accompanying drawings that depict various details of examples selected to show how particular embodiments may be implemented. The discussion herein addresses various examples of the inventive subject matter at least partially in reference to these drawings and describes the depicted embodiments in sufficient detail to enable those skilled in the art to practice the Invention. Many other embodiments may be utilized for practicing the inventive subject matter than the Illustrative examples discussed herein, and many structural and operational changes in addition to the alternatives specifically discussed herein may be made without departing from the scope of the inventive subject matter.

The present disclosure describes various methods and apparatus for monitoring wellbore tortuosity the measurements of bending moments within a drillstring or tool string. In some example embodiments, the bending moments within the tool string will be monitored, either over selected intervals of time or depth, or essentially continuously. In some examples, though the bending moments may be measured essentially continuously, they may be averaged together over selected periods, for example of time or depth, to facilitate further analysis. In some of these examples, the bending moments within the tool string will be measured through use of an assembly having a plurality of strain gauges. In many such examples the strain gauges will be arranged in a selected spacing around the circumference of the tool string, in many examples at a common plane extending generally perpendicular to the longitudinal axis of the string proximate the strain gauges. In some embodiments, the measurements from the plurality of strain gauges at essentially a common point in time will be correlated to define a bending moment present on the string. In many examples, however the bending moments may be determined, they will be further evaluated to provide a measure of wellbore tortuosity. For example, the bending moments may be utilized to define a radius of curvature associated with the determined bending moments in some examples, the determined radius of curvature may be further correlated with a directional measurement that may be referenced, for example, to a high or low side of the wellbore, and/or to a azimuthal orientation to thereby facilitate applying a direction to the bending moment, and therefore to the tortuosity. In many examples, the above measurements and determinations will be performed in essentially real time during a drilling operation. The determinations as to well bore deflections and/or tortuosity can be used to perform remedial measures, where dictated.

Figure 1:
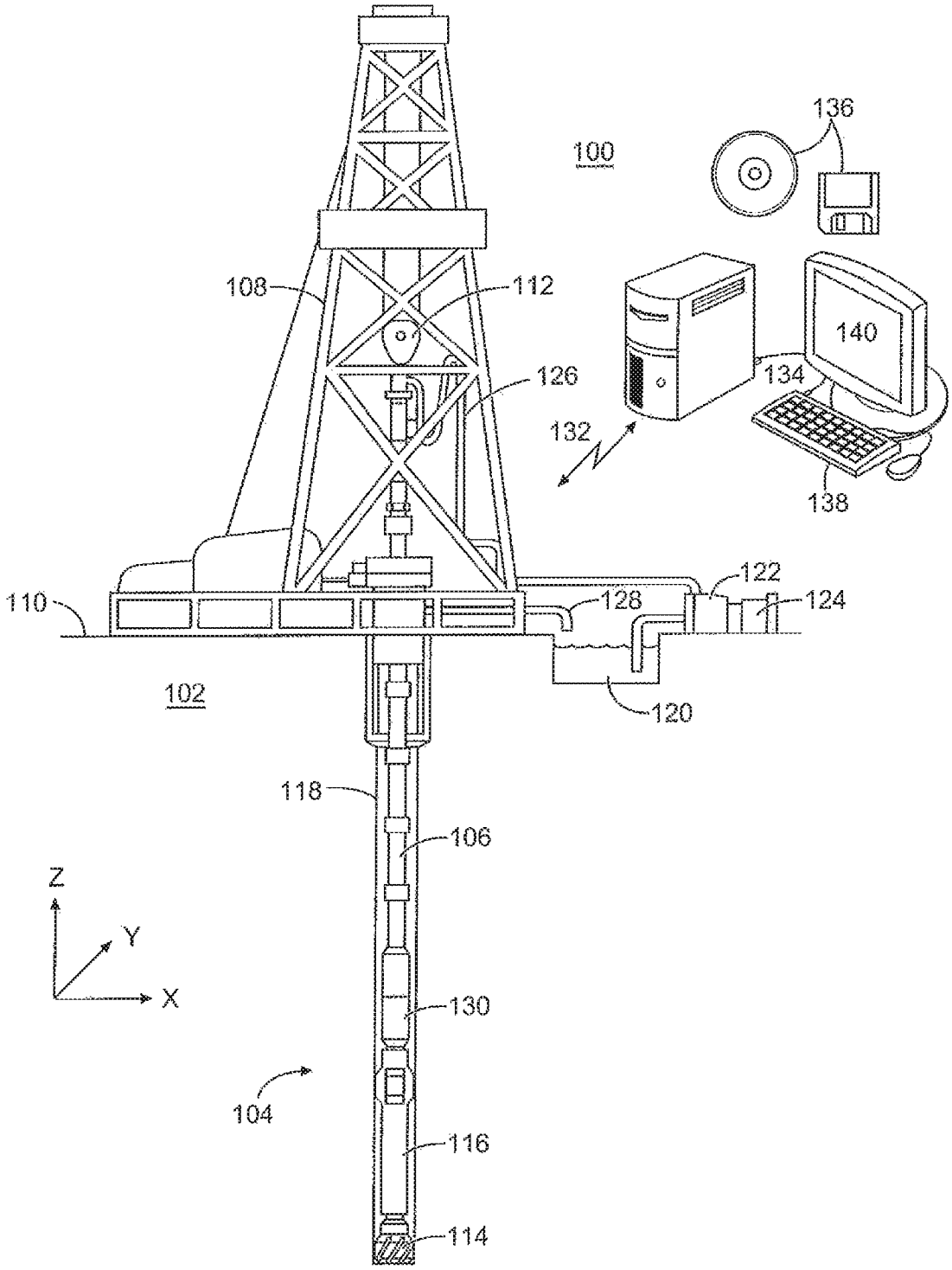
FIG. 1 is a schematic diagram of an example drilling system, according to an embodiment of the present disclosure.

Referring to FIG. 1, illustrated is an exemplary drilling system 100 that can be used in concert with one or more embodiments of the present disclosure. Boreholes are created by drilling into the earth 102 using the drilling system 100. The drilling system 100 is configured to drive a bottom hole assembly (BHA) 104 positioned at the bottom of a drill string 106 extended into the earth 102 from a derrick 108 arranged at the surface 110. The derrick 108 includes a kelly 112 used to lower and raise the drill string 106.

The BHA 104 includes a drill bit 114 and a tool string 116 which is moveable axially within a drilled wellbore 118 as attached to the drill string 106. During operation, the drill bit 114 is provided with sufficient weight on bit (WOB) and torque on bit (TOB) to penetrate the earth 102 and thereby create the wellbore 118. The BHA 104 also provides directional control of the drill bit 114 as it advances into the earth 102. The depicted example BHA 104 can include one or more stabilizers, a mud motor, and/or other components for steering the path of the drill bit 114 during a drilling operation, so as to create a wellbore consistent with a pre-defined well plan.

The tool string 116 can be semi-permanently mounted with various measurement tools (not shown) such as, but not limited to, measurement-while-drilling (MWD) and logging-while-drilling (LWD) tools, that are configured to take downhole measurements of drilling conditions. In other embodiments, the measurement tools are self-contained within the tool string 116, as shown in FIG. 1. As is apparent from the above discussion, the term "tool string," as used herein, includes a drill string, as well as other forms of a tool string known in the art.

Drilling fluid or "mud" from a mud tank 120 is pumped downhole using a mud pump 122 powered by an adjacent power source, such as a prime mover or motor 124. The mud is pumped from the mud tank 120, through a stand pipe 126, which feeds the mud into the drill string 106 and conveys the same to the drill bit 114. The mud exits one or more nozzles arranged in the drill bit 114 and in the process cools the drill bit 114. After exiting from the drill bit 114, the mud circulates back to the surface 110 via the annulus defined between the wellbore 118 and the drill string 106, and in the process returns drill cuttings and debris to the surface. The cuttings and mud mixture are passed through a flow line 128 and into a shaker and optional centrifuge (not shown), which separates the majority of solids, such as cuttings and fines, from the mud, and returns the cleaned mud down hole through stand pipe 126 once again.

A telemetry sub 130 coupled to the BHA transmits telemetry data to the surface via mud pulse telemetry. A transmitter in the telemetry sub 130 modulates a resistance to drilling fluid flow to generate pressure pulses that propagate along the fluid stream at the speed of sound to the surface. One or more pressure transducers convert the pressure signal into electrical signal(s) for a signal digitizer. Note that other forms of telemetry exist and may be used to communicate signals from downhole to the digitizer. Such telemetry may employ acoustic telemetry, electromagnetic telemetry, or telemetry via wired drillpipe.

A digital form of the telemetry signals is supplied via a communications link 132 to a processing unit 134 or some other form of a data processing device. In some examples, the processing unit 134 (which may be a conventional "computer" such as illustrated in FIG. 1 or in any of a variety of known forms) provides a suitable user interface and can provide and control storage and retrieval of data. In many examples, the processing unit 134 will include one or more processors in combination with additional hardware as needed (volatile and/or non-volatile memory; communication ports; I/O device(s) and ports; etc.) to provide the control functionality as described herein. An example processing unit 134 can serve to control the functions of the drilling system 100 and to receive and process downhole measurements transmitted from the telemetry sub 130 to control drilling parameters. In such examples, one or more a non-volatile, machine-readable storage devices 136 (i.e., a memory device (such as DRAM, FLASH, SRAM, or any other form of storage device; which in all cases shall be considered a non-transitory storage medium), a hard drive, or other mechanical, electronic, magnetic, or optical storage mechanism, etc.) will contain instructions suitable to cause the processor to describe the desired functionality, such as the various examples discussed herein). The processing unit 134 operates in accordance with software (which may be stored on non-volatile, machine-readable storage devices 136) and user input via an input device 138 to process and decode the received signals. The resulting telemetry data may be further analyzed and processed by the processing unit 134 to generate a display of useful information on a computer monitor 140 or some other form of a display device. Of course, these functions may be implemented by separate processing units, as desired, and additional functions may be performed by such one or more processing units in response to similarly stored instructions.

Figure 3:
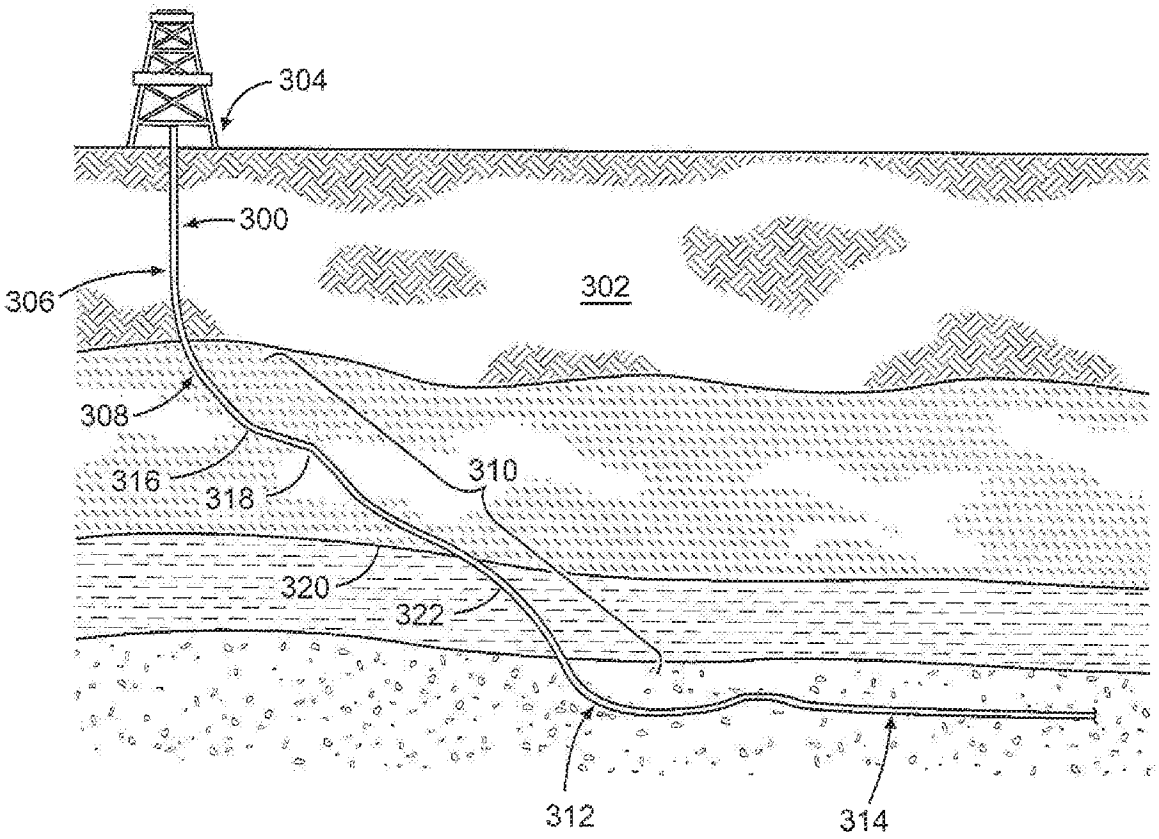
FIG. 3 is a schematic representation of a generalized wellbore traversing a plurality of subterranean formations.

For purposes of illustration, the example of FIG. 1 shows a vertically-oriented borehole configuration, though persons skilled in the art that boreholes will often be formed in a wide variety of configurations, including in some cases some generally horizontally extending portions (as addressed in more detail relative to FIG. 3 herein). Although the drilling system 100 is shown and described with respect to a rotary drill system in FIG. 1, those skilled in the art will readily appreciate that many types of drilling systems can be employed in carrying out embodiments of the disclosure. For instance, drills and drill rigs used in embodiments of the disclosure may be used onshore (e.g., as depicted in FIG. 1) or in offshore environments as well, such as for subsea operations (not shown). In particular, offshore or subsea operations may include use of the MWD/LWD drilling apparatus and techniques including aspects of the examples herein. Offshore oil rigs that may be used in accordance with embodiments of the disclosure include, for example, floaters, fixed platforms, gravity-based structures, drill ships, semi-submersible platforms, jack-up drilling rigs, tension-leg platforms, and the like; and embodiments of the disclosure can be applied to rigs ranging anywhere from small and portable to bulky and permanent.

Further, although described herein with respect to oil drilling, various embodiments of the disclosure may be used in many other applications. For example, disclosed methods can be used in drilling for mineral exploration, environmental investigation, natural gas extraction, underground installation, mining operations, water wells, geothermal wells, and the like.

Figure 2:
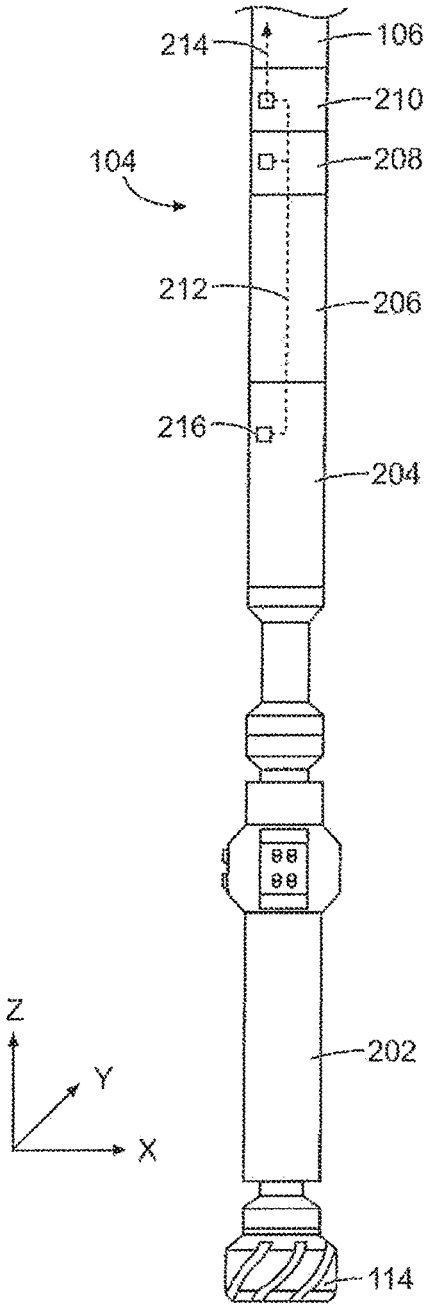
FIG. 2 is a schematic diagram of an example bottom-hole assembly, according to one or more embodiments of the present disclosure.

Referring now to FIG. 2, with continued reference to FIG. 1, illustrated is an exemplary bottom-hole assembly (BHA) 104 that can be employed in concert with one or more embodiments of the present disclosure. Although described throughout with respect to a BHA, the embodiments described herein can be alternatively or additionally applied at multiple locations throughout a drill string, and are therefore not limited to the generalized location within only a conventional BHA (i.e., at the bottom of a drill string). As shown, the BHA 104 includes the drill bit 114, a rotary steerable tool 202, an MWD/LWD tool 204, and a drill collar 206.

The MWD/LWD tool 204 further includes an MWD sensor package having one or more sensors 216 of an appropriate configuration to collect and transmit one or more of directional information, mechanical information, formation information, and the like. In particular, the one or more sensors 216 include one or more internal or external sensors such as, but not limited to, an inclinometer, one or more magnetometers (i.e., compass units) or other azimuthal sensor, one or more accelerometers (or other vibration sensor), a shaft position sensor, an acoustic sensor, as well as other forms of sensors (such as various forms of formation sensors), as well as combinations of the above. The distance between the sensors 216 and the drill bit 114 can be any axial length required for the particular wellbore application. Directional information (e.g., wellbore trajectory in three-dimensional space) of the BHA 104 within the earth 102 (FIG. 1), such as inclination and azimuth, can be obtained in real-time using the sensors 216.

The MWD/LWD tool 204 can further include a formation sensor package that includes one or more sensors configured to measure formation parameters such as resistivity, porosity, sonic propagation velocity, or gamma ray transmissibility. In some embodiments, the MWD and LWD tools, and their related sensor packages, are in communication with one another to share collected data. The MWD/LWD tool 204 can be battery driven or generator driven, as known in the art, and any measurements obtained from the MWD/LWD tool 204 can be processed at the surface 110 (FIG. 1) and/or at a downhole location.

The drill collar 206 is configured to add weight to the BHA 104 above the drill bit 114 so that there is sufficient weight on the drill bit 114 to drill through the requisite geological formations. In other embodiments, weight is also applied to the drill bit 114 through the drill string 106 as extended from the surface 110. Weight may be added or removed to/from the drill bit 114 during operation in order to optimize drilling performance and efficiency. For example, the curvature of the borehole can be predicted and the weight applied to the drill bit 114 optimized in order to take into account drag forces or friction caused by the curvature. As will be appreciated, increased amounts of drag forces will be present where the borehole curvature is more dramatic.

The BHA 104 further includes a sensor sub 208 coupled to or otherwise forming part of the BHA 104. The sensor sub 208 is configured to monitor various operational parameters in the downhole environment with respect to the BHA 104. For instance, the sensor sub 208 can be configured to monitor operational parameters of the drill bit 114 such as, but not limited to, weight-on-bit (WOB), torque-on-bit (TOB), rotations per minute (RPM) of the drill bit 114, bending moment of the drill string 106, vibration potentially affecting the drill bit 114, and the like. As illustrated, the sensor sub 208 is positioned uphole from the MWD/LWD tool 204 and the drill collar 206. In other embodiments, however, the sensor sub 208 can be positioned at any location along the BHA 104 without departing from the scope of the disclosure. In order to measure the bending moment, the sensor sub 208 will preferably include a plurality of strain gauges. For purposes of the presently described methods and apparatus, the strain gauges will include a plurality of groups of strain gauges, with each group including at least two strain gauges oriented to measure strain in orthogonally-oriented directions. Preferably, at least one strain gauge in each group will be oriented to measure strain on an axis parallel to the longitudinal axis through the sensor sub.

In some embodiments, the sensor sub 208 is a DRILLDOC® tool commercially available from Sperry Drilling of Houston, Tex., USA. The DRILLDOC® tool, or another similar type of sensor sub 208, can be configured to provide real-time measurements of weight, torque and bending on an adjacent cutting tool (e.g., the drill bit 114) and/or drill string 106 to characterize the transfer of energy from the surface to the cutting tool and/or drill string 106. For example, the DRILLDOC® tool is a MWD tool which is placed inside the drill collar 206 to provide the real-time measurements of tension, torsion, bending, and vibration at the drill collar 206. The strain force and torque measurements from the DRILLDOC® tool are used to estimate the bit force and torque. As will be appreciated, these measurements help optimize drilling parameters to maximize performance and minimize wasted energy transfer and vibration.

The DRILLDOC® sensor sub 208 includes three groups of strain sensors distributed at positions azimuthally offset at essentially 120° apart from one another around the periphery of the sub. The DRILLDOC® sensor sub includes four strain gauges in each group that are oriented axially (i.e. generally parallel to the longitudinal axis through the sub) to measure tension and compression of the BHA; and four strain gauges in each group that are oriented orthogonally to the axially oriented gauges (i.e., extending laterally, generally perpendicular relative to the longitudinal axis through the sub) to measure the torque present in the sub. The axially oriented strain gauges are also used to define the bending moment which results from variable tension and compression in the sub under applied axial load. These strain gauges are in a known configuration relative to an orienting sensor for the sub or drillstring to identify the direction of any identified bending moment under the applied axial load. As a result, both the magnitude and direction of a deflection in the wellbore resulting in the bending moment can be identified.

The BHA 104 further includes a bi-directional communications module 210 coupled to or otherwise forming part of the drill string 106. The communications module 210 can be communicably coupled to each of the sensor sub 208 and the MWD/LWD tool 204 (e.g., its sensor(s) 216) via one or more communication lines 212 such that the communications module 210 is configured to send and receive data to/from the sensor sub 208 and the MWD/LWD tool 204 in real time.

The communications module 210 can further be communicably coupled to the surface (not shown) via one or more communication lines 214 such that the communications module 210 is able to send and receive data in real time to/from the surface 110 (e.g., from FIG. 1) during operation. For instance, the communications module 210 communicates to the surface 110 various downhole operational parameter data as acquired via the sensor sub 208 and the MWD/LWD tool 204. In other embodiments, however, the communications module 210 communicates with a computerized system (not shown) or the like configured to receive the various downhole operational parameter data as acquired through the sensor sub 208 and the MWD/LWD tool 204. As will be appreciated, such a computerized system arranged either downhole or at the surface 110.

The communication lines 212, 214 can be any type of wired telecommunications devices or means known to those skilled in the art such as, but not limited to, electric wires or lines, fiber optic lines, etc. For instance, in some embodiments, a wired drill pipe (not shown) is used for two-way data transmission between the surface 110 and the communications module 210. Using a wired drill pipe, the BHA 104 and the drill string 106 have electrical wires built in to one or more of their components such that measurements and signals from the MWD/LWD tool 204 and the sensor sub 208 are carried directly to the surface 110 at high data transmission rates. Alternatively or additionally, the communications module 210 includes or otherwise comprises a telemetry module used to transmit measurements to the surface 110 wirelessly, if desired, using one or more downhole telemetry techniques including, but not limited to, mud pulse, acoustic, electromagnetic frequency, combinations thereof, and the like.

Referring now to FIG. 3, that figure is a schematic representation of a generalized wellbore, Indicated generally at 300, traversing a plurality of subterranean formations, indicated generally at 302. Wellbore 300 extends from a wellhead, 304 at the surface and extends in a generally vertical section, indicated generally at 306. A first radius, indicated generally at 308, causes the wellbore to extend azimuthally relative to the generally vertical section 306, initially in a generally linear inclined region, indicated generally at 310, before reaching a another radius, indicated generally at 312, causing wellbore 300 to extend along a generally horizontal path, as indicated at 314. While inclined region 310 is generally linear, the specific path is not entirely linear, by virtue of deflection points (or "dog-legs"), as shown at 316, 318, 320, and 322. Such dog-legs (deflections) in the wellbore can occur as a result of subsurface anomalies that impede direction of the bit in a controlled manner or by the alternation between a period of steering the bit and a period of non-steering of the bit, as commonly occurs during a directional drilling operation.

The passage of the tool string past each of these deflection points 316, 318, 320, and 322 will impose some bending moment upon the tool string. As described herein, the present invention provides an apparatus to measure these bending moments, when imposed, which can facilitate both identification of the location of a local discontinuity in the wellbore path (which may be either a deviation from an identified radius, or from a linear path), and determination of the magnitude, or severity, of the dog-leg. In selected embodiments, a plurality of determined dog-legs and their severities will be compiled over at least some portion of the length of the wellbore, and can then be used to determine a dog-leg severity index as a function of depth within the wellbore. Use of such a dog-leg severity index facilitates performing of subsequent operations within the wellbore, as discussed in more detail later herein.

The radius of curvature ($R_c$) at a location within the wellbore, expressed in degrees/100 ft., can be determined from the measured bending moment such as through the following relation:

$$R_c=(M/EI)\times(180/\pi) \quad \text{eq. 1}$$

Where:
M=the measured bending moment (ft-lbs);
E=the modulus of elasticity of the tool string; and
I=the moment of inertia, which, for a cylindrical pipe can be expressed as:

$$I=\pi/64(d_0^4-d_i^4) \quad \text{eq. 2}$$

Where:
$d_0$=the outer diameter of the pipe; and
$d_i$=the inner diameter of the pipe.
In complex tools containing non-homogeneous cross-sections that include electronics and wiring, the equivalent stiffness dimensions of the components can be used.

Figure 4A:
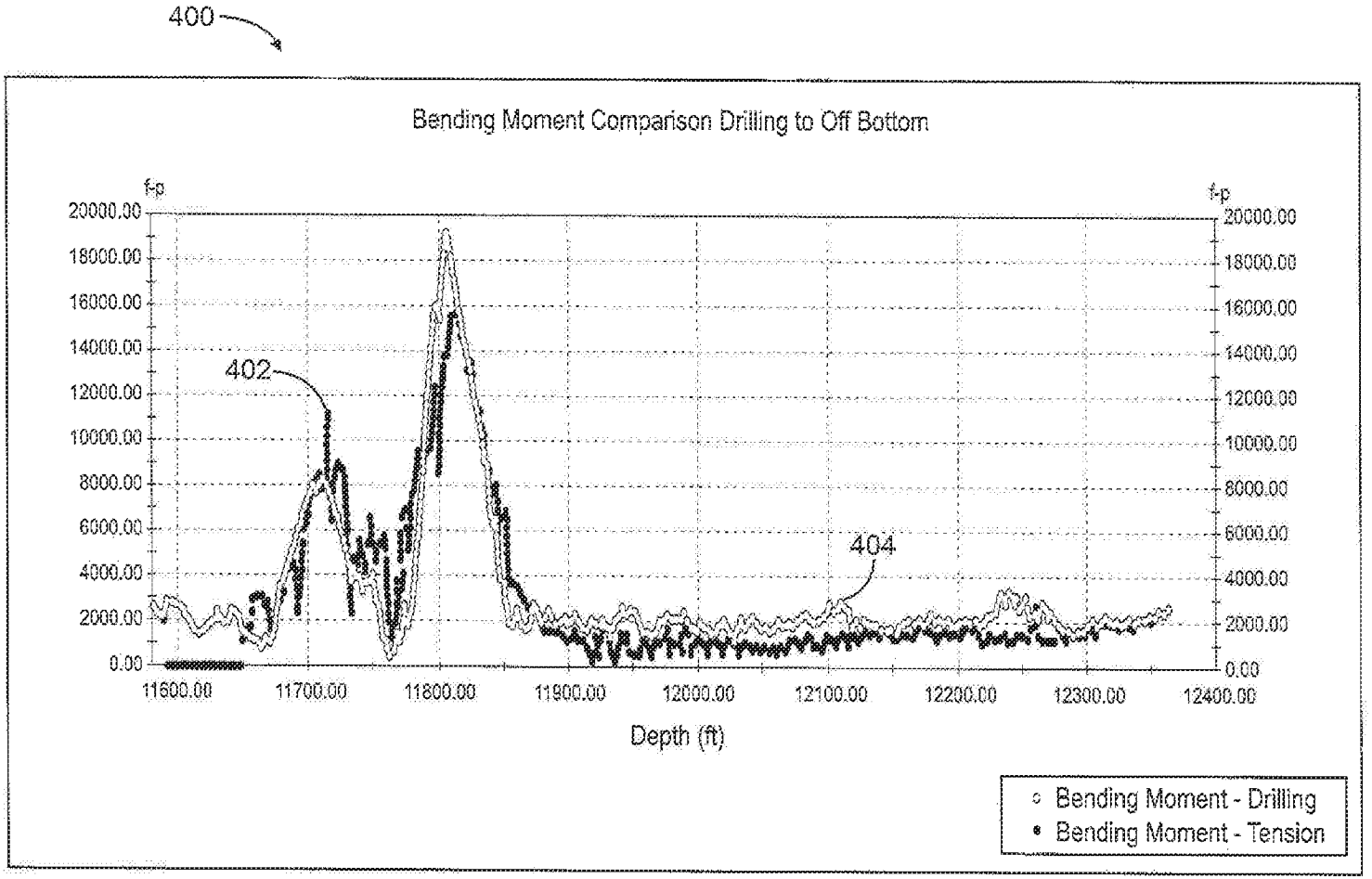
FIGS. 4A-B, are graphical representations of example bending moment measurements under different loads as might be determined in an example wellbore; in which FIG. 4A compares example determined bending moments under tension with example determined bending moments under drilling conditions (i.e., during compression); and in which FIG. 4B compares example determined bending moments under tension with example determined bending moments under drilling conditions as a function of direction.
Figure 4B:
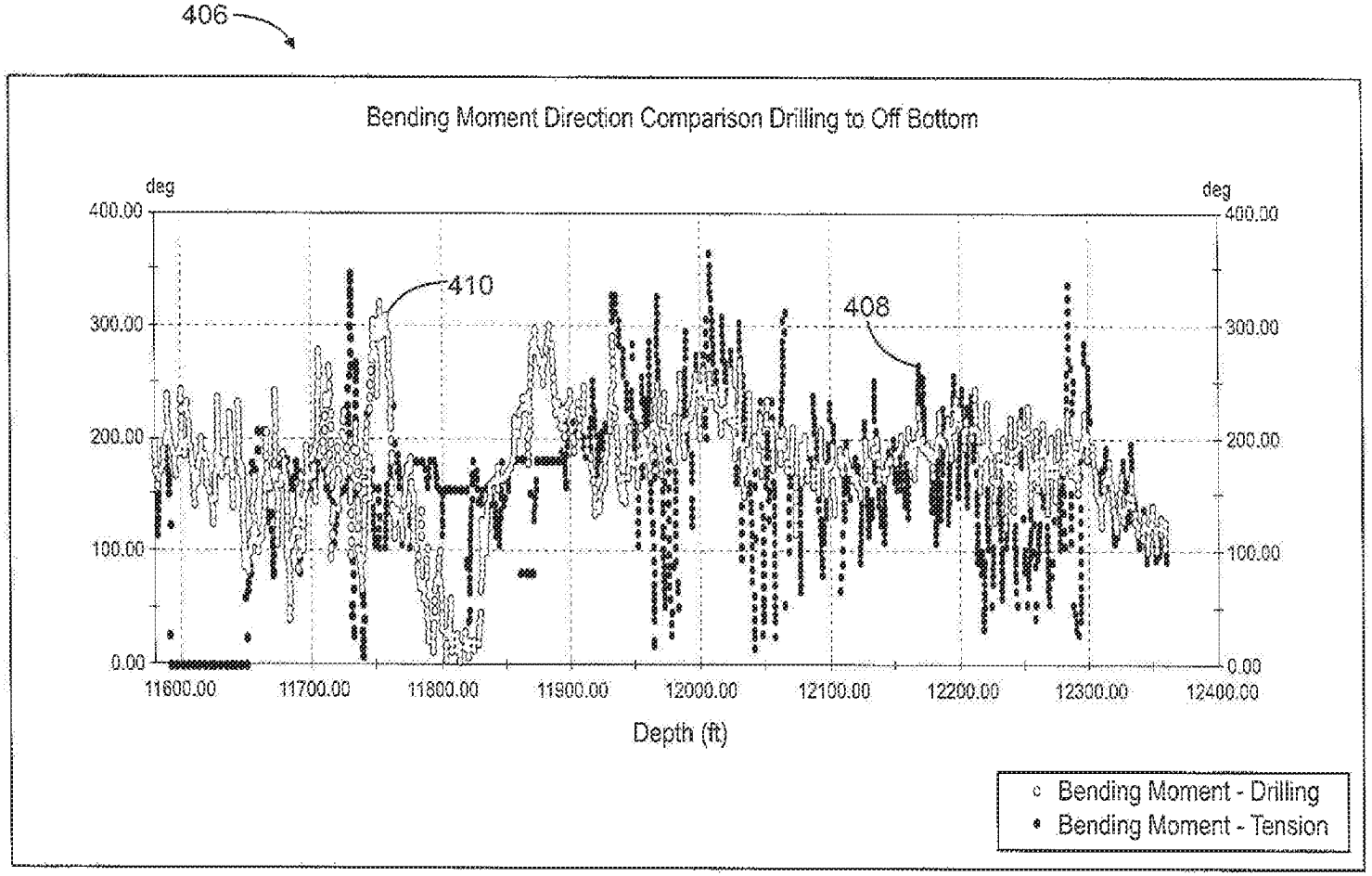

Referring now to FIG. 4A-B, those figures depict graphical representations of example bending moment measurements under different loads as might be determined in an example wellbore; in which FIG. 4A compares example determined bending moments with the tool string under tension, in curve 402 with example determined bending moments with the tool string under drilling conditions (i.e., with the tool string in compression), in curve 404; and in which FIG. 4B compares example determined bending moments under tension as a function of direction, in curve 406, with corresponding determined bending moments under drilling conditions, in curve 408. In FIG. 4B, 0° represents the high side of the wellbore.

Referring now to FIG. 4A, the bending moments determined under tension and compression are generally comparable. When the tool string is in tension the tool string should be generally straight, at least between stabilized locations, but for a deflection in the wellbore acting upon the tool string. The general correspondence between the direction of the bending moment under both tension and compression, as shown in FIG. 4B, further indicates that the identified bending moment should be a function of the wellbore conformation, and not some other anomaly.

Figure 5:
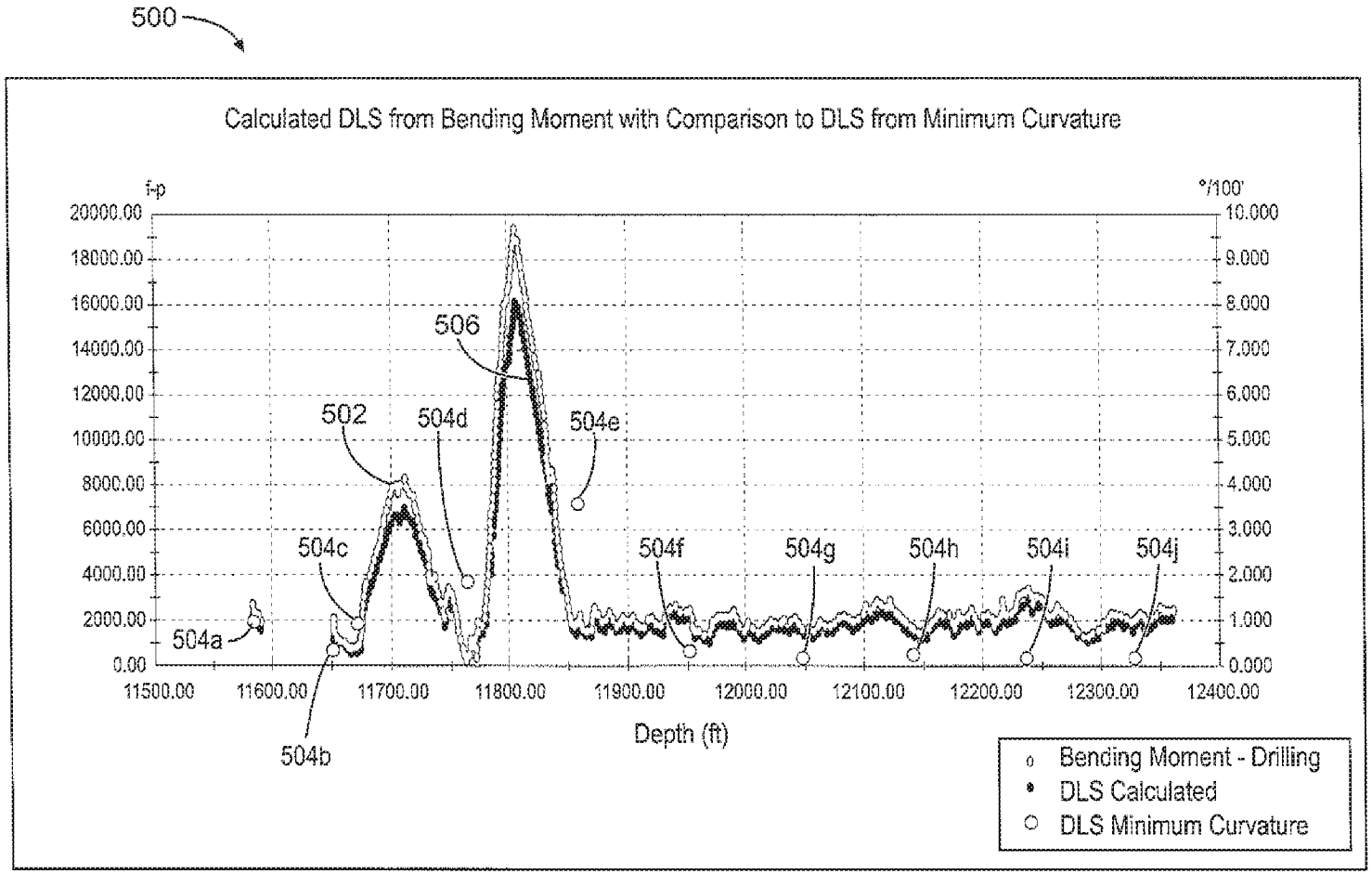
FIG. 5 is a graphic depiction of a dog-leg severity as determined from the measured bending moment compared to expected values of dog-leg severity.

Referring now to FIG. 5, the figure is a graphic depiction of a dog-leg severity determined from the measured bending moment, indicated a curve 502, in comparison to both: a calculated dog-leg severity based upon a minimum curvature analysis of the well plan, indicated at locations 504*a-i*, and a dog-leg severity as could be determined from well survey measurements, indicated by curve 506. As can be seen from the locations of the well plan minimum curve analysis, the path of the reflected wellbore would be a generally smooth and continuous one. The dog-leg severity as determined from the survey information, at 506, reflects significantly greater tortuosity than would be anticipated from the well plan. However the dog-leg severity as determined from the measured bending moments reflects far greater tortuosity, and more significant localized curvature, than is suggested by the survey-based dog-leg severity.

Figure 6:
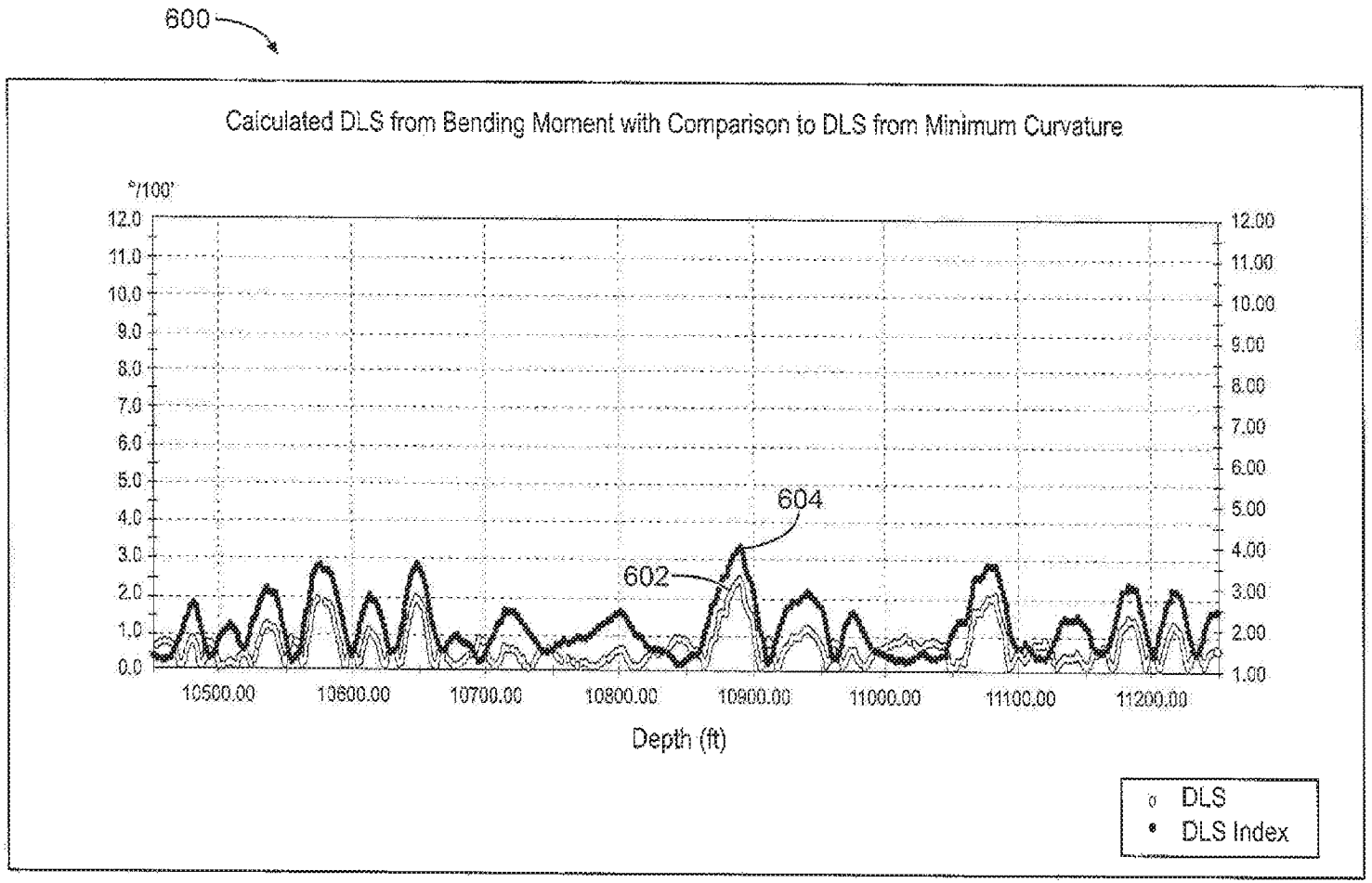
FIG. 6 is a graphical representation of an example dog-leg severity index determined from the bending moment, in comparison with a dog-leg severity as determined from survey data.

Referring now to FIG. 6, that figure is a graphical representation of an example dog-leg severity index determined from the measured bending moment, depicted by curve 602 in comparison with a dog-leg severity as determined from survey data, depicted by curve 604. In comparing the measured dog-leg severity 604, with an expected dog-leg severity (not shown) supports the derivation of the dog-leg severity index. The value of "one" (1) indicates that the survey-determined-dog-leg severity and the bending moment-measured dog-leg severity are the same, and no additional tortuosity exists. In the depicted example, the dogleg severity is relatively mild, and even the measured dog-leg severities are likely well within design tolerances. However, the example illustrates the graphical identification of the magnitude of dog-leg severity in various locations within the wellbore in a form that may be used to guide further drilling and/or other operations within the same well, and/or to guide drilling in other wells within the geographical area.

A dog-leg severity index based upon the measured bending moments can be determined by relationship such as the following (which is similar to equation 1 above but which factors in the differences between an expected bending moment and a measured bending moment):

$$R_e=\sqrt{(M-M_e)^2}/(EI)\times(180/\pi) \quad \text{eq. 4}$$

Where:

M=the bending moment as determined from the strain gauge measurements; and $M_e$=the expected bending moment, which may be based, for example, on survey measurements or the well plan.

Deviation of the bending moment-based dog-leg severity from either the well plan or survey measurements may be indicative of performance characteristics of the BHA configuration used in the well. In some example operations it may be desirable to change the configuration of the BHA for continued drilling and that well or for use in nearby wells. In some example operations, the configuration or the method of operation of a given BHA may result in greater than expected dog-leg severity, and therefore may be used to change the method of operation of the BHA to minimize such effects. Additionally, the bending moment-based dog-leg severity index may be used to define a well path for future wells in the area, as it provides a measure of the capability of not only a given BHA, but also of potential formation tendencies upon a well plan using that BHA.

For example, remedial actions may be undertaken to minimize the severity of a dog-leg at one or more locations, for example, so as to facilitate placement of casing within the wellbore, Including the cementing of the casing. As just one example, the dog-leg severity index can be used to identify when there is spiraling of the wellbore, caused by the drill bit traveling in a generally spiraling path, leading to highly rugose surfaces defining the wellbore, which can complicate subsequent cementing of a casing in place. In cases where the dog-leg severity index indicates such spiraling, it may be possible to enlarge that portion of the wellbore, such as through use of a reamer to minimize the undesirable properties in that section of the wellbore, by changing the dimensions of the wellbore in that region. Other types of wellbore operations may be performed as a result of the identified areas of dog-leg severity, including wellbore conditioning (such as by extended circulating times and/or additives placed into the wellbore, by reaming or otherwise enlarging portions of the wellbore, or other operations, as will be apparent to persons skilled in the art.

Figure 7:
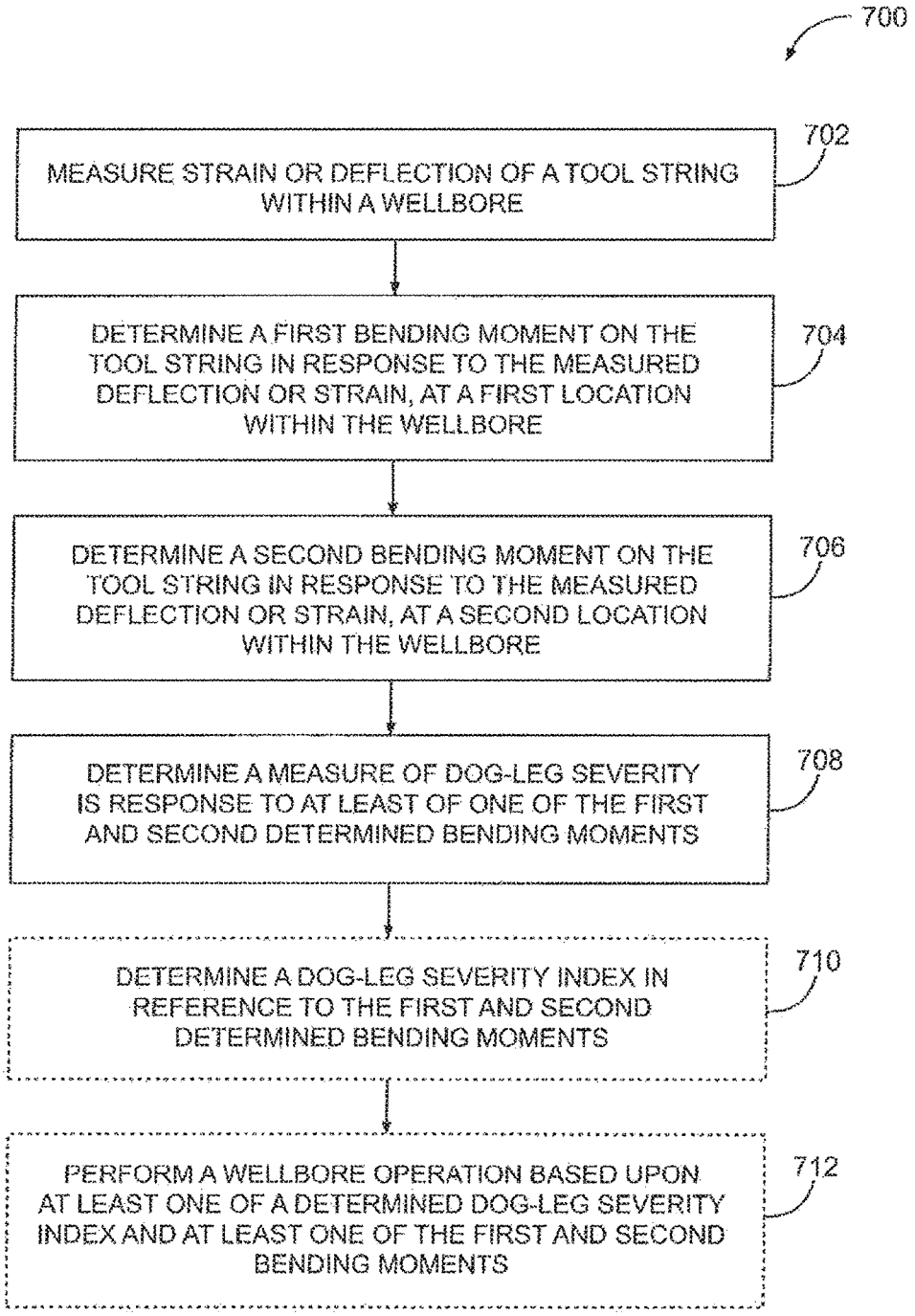
FIG. 7 is a flow chart of an example method of performing operations for monitoring wellbore tortuosity as described herein.

Referring now to FIG. 7, the Figure depicts a flow chart 700 of an example method of performing operations as described herein. At step 702, a measurement will be made of strainer deflection of the tool string within a wellbore. At 704, a first bending moment on the tool string will be determined in response to that measure deflection or strain, as measured at a first location within the wellbore. At 706, a second bending moment on the tool string will be determined in response to a measured deflection or strain at a second location within the wellbore. And at 708, a measure of dog-leg severity will be determined in response to at least one of the first and second determined bending moments, as described earlier herein. Optionally, it may be desired to determine the dog-leg severity index for the tool string within the wellbore in reference to the first and second determined bending moments, as indicated at 710. The dog-leg severity index may be configured in such a way as to provide an indication of the magnitude of the dog-leg severity over a desired section of the wellbore, or may be configured, as described earlier herein to provide a comparison of the dog-leg severity relative to one or more expected dog-leg magnitudes. In many implementations, the comparison will be a visually identifiable indicator of the measured dog-leg such as the graphical representations as shown in FIGS. 5 and 6. Also optionally, as indicated at 712, either a determined dog-leg severity index or at least one of the first and second determined bending moments can be used to perform a wellbore operation, either in the wellbore containing the tool string or in a another wellbore. As described earlier herein, a variety of different types of operations may be performed based upon the information provided by the determined bending moments present upon the tool string and/or an index of the severity of the dog-leg associated with such bending moments.

In some embodiments, the present disclosure may be embodied as a set of instructions on a computer readable medium comprising ROM, RAM, CD, DVD, hard drive, flash memory device, or any other non-volatile, machine-readable storage devices, now known or unknown, that when executed causes one or more processing units of a computerized system (such as processing unit 134 of FIG. 1) to implement a method of the present disclosure, for example the method described in FIG. 10.

In some examples, the processing unit 134 (which may be a conventional "computer" (in any of a variety of known forms)) provides a suitable user interface and can provide and control storage and retrieval of data. In many examples, the processing unit 134 will include one or more processors in combination with additional hardware as needed (volatile and/or non-volatile memory; communication ports; I/O device(s) and ports; etc.) to provide the control functionality as described herein. An example processing unit 134 can serve to control the functions of the drilling system and to receive and process downhole measurements from the sensor subs to estimate bit forces and control drilling parameters. In such examples, one or more a non-volatile, machine-readable storage devices (i.e., a memory device (such as DRAM, FLASH, SRAM, or any other form of storage device; which in all cases shall be considered a non-transitory storage medium), a hard drive, or other mechanical, electronic, magnetic, or optical storage mechanism, etc.) will contain instructions suitable to cause the processor to describe the desired functionality, such as the various examples discussed herein). Of course, these functions may be implemented by separate processing units, as desired, and additional functions may be performed by such one or more processing units in response to similarly stored instructions.

In some embodiments, a portion of the operations, such as those set forth in reference to FIG. 7, and elsewhere herein may be performed downhole, by a processing unit in the BHA, while another portion may be performed by a processing unit at the surface, as discussed in reference to FIG. 1. As just one example, bending moments might be determined downhole in reference to measurements from the strain gauges (or other deflection measurement sensors), and then communicated to the surface, as described herein, for correlation with predicted or planned bending moment values. In such case, each processing unit will include some machine-readable storage mechanism containing at the instructions necessary to cause the processor at that location to perform the operations to be performed at that location.

Though method of performing the described measurements and determinations are described serially in the examples of FIGS. 1-7, one of ordinary skill in the art will recognize that other examples may reorder the operations, omit one or more operations, and/or execute two or more operations in parallel using multiple processors or a single processor organized as two or more virtual machines or sub-processors. Moreover, still other examples can implement the operations as one or more specific interconnected hardware or integrated circuit modules with related control and data signals communicated between and through the modules. Thus, any process flow is applicable to software, firmware, hardware, and hybrid implementations.

In this description, references to "one embodiment" or "an embodiment," or to "one example" or "an example" mean that the feature being referred to is, or may be, included in at least one embodiment or example of the invention. Separate references to "an embodiment" or "one embodiment" or to "one example" or "an example" in this description are not intended to necessarily refer to the same embodiment or example; however, neither are such embodiments mutually exclusive, unless so stated or as will be readily apparent to those of ordinary skill in the art having the benefit of this disclosure. Thus, the present disclosure includes a variety of combinations and/or integrations of the embodiments and examples described herein, as well as further embodiments and examples as defined within the scope of all claims based on this disclosure, as well as all legal equivalents of such claims.

In no way should the embodiments described herein be read to limit, or define, the scope of the disclosure. Embodiments described herein with respect to one implementation, such as MWD/LWD, are not intended to be limiting.

The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be used and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A method for monitoring wellbore tortuosity through a tool string, comprising:

measuring deflection of the tool string at a plurality of locations surrounding the tool string when the tool string is at a first depth within the wellbore;

determining a first bending moment on the tool string in response to the measured deflection;

determining a first measure of dog-leg severity in response to the determined first bending moment;

measuring deflection of the tool string at a plurality of locations surrounding the tool string when the tool string is at a second depth within the wellbore;

determining a second bending moment on the tool string in response to the measured deflection at the second depth;

determining a second measure of dog-leg severity in response to the determined second bending moment;

identifying a surface roughness in the wellbore based on first and second measures of dog-leg severity; and undertaking remedial actions to reduce the severity of the surface roughness at the one or more locations.

2. The method of claim 1, further comprising determining a dog-leg severity index in reference to the first and second measures of dog-leg severity, and to an expected dog-leg severity.

3. The method of claim 2, wherein the deflection of the tool string is measured at a plurality of radially spaced locations around the tool string wherein the locations are placed at essentially a common depth along the tool string.

4. The method of claim 3, wherein the plurality of radially spaced locations around the tool string where deflection is measured comprises at least three locations at a common depth along the tool string.

5. The method of claim 1, further comprising establishing a graphical representation of the deflection of the wellbore at the first and second depths in the wellbore.

6. An apparatus for monitoring wellbore tortuosity through a tool string, comprising:

a tool string having a plurality of groups of strain gauges, wherein the groups are arranged around the periphery of a tool in the tool string, wherein each strain gauge group comprises at least two strain gauges arranged to measure strain relative to at least two perpendicular axes, and wherein the groups of strain gauges are symmetrically arranged relative to a common plane extending generally perpendicular to the tool sting proximate the location of the strain gauges; and one or more processors in communication with one or more machine readable media bearing instructions, which when executed by the one or more processors, collectively perform operations comprising, receiving a first set of measurements from strain gauges in the plurality of groups of strain gauges, determining a first bending moment on the tool string in response to first set of measurements, determining a first measure of dog-leg severity in response to the determined first bending moment, receiving a second set of measurements from strain gauges in the plurality of groups of strain gauges, determining a second bending moment on the tool string in response to the second set of measurements, determining a second measure of dog-leg severity in response to the determined second bending moment, identifying a surface roughness in the wellbore based on first and second measures of dog-leg severity, and causing the tool string to undertake remedial actions to reduce the severity of the surface roughness.

7. The apparatus of claim 6, wherein the operations further comprise creating a dog-leg severity index based at least in part on the first and second measures of dog-leg severity.

8. A method for evaluating and modifying a drilling operation, comprising:

measuring deflection of a tool string relative to a first axis at a plurality of depths within a wellbore, the deflection measured by measuring strain in a component of a drillstring at each of the plurality of depths, the strain measured at a plurality of azimuthally offset locations around the component at each of the plurality of depths;

determining a bending moment on the drillstring at each of the plurality of depths in response to the measured deflection at such depth;

determining localized directional shifts of the wellbore in response to the measured bending moments at each of the plurality of depths;

identifying a surface roughness in the wellbore based on the localized directional shifts at one or more locations in the wellbore; and undertaking remedial actions to reduce the severity of the surface roughness a dogleg at the one or more locations.

9. The method of claim 8, further comprising determining a measure of the directional shifts of the wellbore in reference to both the directional shifts of the wellbore as determined from the measured bending moments and also the expected directional shifts of the wellbore.

10. The method of claim 9, further comprising identifying spiraling in the wellbore at the one or more locations and wherein the remedail actions include reaming the wellbore at the one or more locations in response to the identified spiraling in of the wellbore.

11. The method of claim 10, wherein changing the wellbore in response to the determined measure of the directional shifts of the wellbore includes enlarging a portion of the wellbore.

12. The method of claim 9, wherein determining a measure of the directional shifts of the wellbore comprises determining a dogleg severity index.

13. The method of claim 8, further comprising measuring lateral deflection of a tool string at the plurality of depths within the wellbore, the lateral deflection measured by determining strain in the lateral direction of the tool string at a plurality of azimuthally offset locations around the tool string.

14. An apparatus for monitoring directional shifts in a wellbore, comprising:

a tool string having a measurement tool comprising a plurality of strain gauges azimuthally offset from one another around the periphery of the measurement tool, each strain gauge arranged to measure strain in a longitudinal direction;

one or more processors;

one or more machine readable media in communication with one or more of the processors, the machine readable media bearing instructions, which when executed by the one or more processors, collectively perform operations comprising, receiving measurements from the strain gauges at a plurality of depths in the wellbore, determining a first bending moment on the tool string at at least one depth in the wellbore in response to the received measurements;

establishing a visually identifiable indicator of the deflection of the wellbore at least one depth in the wellbore in response to the determined first bending moment, determining additional bending moments on the tool string at additional depths in the wellbore, identifying a surface roughness in the wellbore based on first and additional bending moments, and causing the tool string to undertake remedial actions to reduce the severity of the surface roughness.

15. The apparatus of claim 14, wherein the visually identifiable indicator of the deflection of the wellbore comprises a graphical representation.

16. The apparatus of claim 14, wherein the visually identifiable indicator of the deflection of the wellbore includes an indication of the magnitude of the deflection of the wellbore relative to a planned deflection of the wellbore at the at least one depth in the wellbore.

17. The apparatus of claim 14, wherein the visually identifiable indicator of the deflection of the wellbore comprises a graphical representation of the deflection of the wellbore relative to a planned deflection of the wellbore at a plurality of depths in the wellbore.

* * * * *